US011004646B2

(12) United States Patent
Suzuki

(10) Patent No.: US 11,004,646 B2
(45) Date of Patent: May 11, 2021

(54) X-RAY TUBE AND X-RAY GENERATION DEVICE

(71) Applicant: HAMAMATSU PHOTONICS K.K., Hamamatsu (JP)

(72) Inventor: Kazutaka Suzuki, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/494,799

(22) PCT Filed: Feb. 26, 2018

(86) PCT No.: PCT/JP2018/006980
§ 371 (c)(1),
(2) Date: Sep. 17, 2019

(87) PCT Pub. No.: WO2018/198517
PCT Pub. Date: Nov. 1, 2018

(65) Prior Publication Data

US 2020/0098539 A1 Mar. 26, 2020

(30) Foreign Application Priority Data

Apr. 28, 2017 (JP) ..... JP2017-090044

(51) Int. Cl.
*H01J 35/10* (2006.01)
*H01J 35/12* (2006.01)
(Continued)

(52) U.S. Cl.
CPC ..... *H01J 35/12* (2013.01); *H01J 35/18* (2013.01); *H05G 1/025* (2013.01)

(58) Field of Classification Search
CPC .. H01J 35/08; H01J 35/12; H01J 35/18; H01J 35/16; H01J 2235/122; H01J 35/116;
(Continued)

(56) References Cited

U.S. PATENT DOCUMENTS 2,905,841 A 9/1959 Meyer et al.
3,239,706 A 3/1966 Farrell et al.
(Continued)

FOREIGN PATENT DOCUMENTS

CN 105702544 A 6/2016
JP H04-262348 A 9/1992
(Continued)

OTHER PUBLICATIONS

International Preliminary Report on Patentability (IPRP) dated Nov. 7, 2019 that issued in WO Patent Application No. PCT/JP2018/006980.

*Primary Examiner* — Irakli Kiknadze
(74) *Attorney, Agent, or Firm* — Faegre Drinker Biddle & Reath LLP

(57) ABSTRACT

An X-ray tube includes: a vacuum housing configured to include an internal space which is vacuum; a target unit configured to be disposed in the internal space, and include a target that generates an X-ray by using an electron beam incident therein, and a target support unit that supports the target, the X-ray generated by the target being transmitted through the target support unit; and an X-ray emission window configured to be so provided as to face the target support unit, and seal an opening of the vacuum housing, the X-rays transmitted through the target support unit being transmitted through the X-ray emission window. At least a part of the X-ray emission window is in contact with the target support unit.

9 Claims, 7 Drawing Sheets

(51) Int. Cl.
*H01J 35/18* (2006.01)
*H05G 1/02* (2006.01)

(58) Field of Classification Search
CPC ..... H01J 2235/06; H01J 2235/1204; H01J 2235/1216; H01J 2235/16; H01J 2235/167; H01J 35/14; H01J 35/186; H01J 2235/1262; H01J 2235/168; H01J 2235/086; H01J 2235/088; H01J 2235/165; H01J 2235/068; H01J 2235/163; H01J 2235/1295; H01J 35/06; H01J 35/064; H01J 35/066; H01J 35/101; H01J 35/112; H01J 2235/18; H01J 35/04; H01J 35/24; H01J 35/28; H01J 2235/081; H01J 35/147; H01J 35/105; H05G 1/025; H05G 1/06; H05G 1/00; H05G 1/10; H05G 1/22; H05G 2/001; G01N 23/04; G01N 23/223; G01N 23/205; G01N 23/085; G01N 23/2076; G21K 1/02; G21K 1/06; G21K 2201/064; G21K 1/067; G21K 1/062; G21K 2201/061; G03F 7/16; G03F 7/36; G01B 15/02; A61B 6/032; A61B 6/035; A61B 6/06; A61B 6/4007; A61B 6/4028; A61B 6/4064; A61B 6/4241; A61B 6/4435; A61B 6/4488; A61B 6/587; A61B 6/40; A61B 6/12; A61B 6/4494; A61B 6/462; A61B 6/463; A61B 6/464; A61B 6/481; A61B 6/487; A61B 6/504; A61B 6/5235; A61B 6/542; A61B 6/548
USPC ..... 378/140–143
See application file for complete search history.

(56) References Cited

U.S. PATENT DOCUMENTS

| | | | | |
|---|---|---|---|---|
| 5,629,969 | A | 5/1997 | Koshishiba | |
| 7,526,069 | B2 * | 4/2009 | Matsumura | H01J 35/18 378/119 |
| 9,589,759 | B2 * | 3/2017 | Miyaoka | H01J 19/56 |
| 2009/0161830 | A1 * | 6/2009 | Inazuru | H01J 35/14 378/138 |
| 2013/0016812 | A1 * | 1/2013 | Yanagisawa | H01J 35/16 378/62 |
| 2014/0126702 | A1 | 5/2014 | Haag et al. | |

FOREIGN PATENT DOCUMENTS

| | | | |
|---|---|---|---|
| JP | H05-142398 | A | 6/1993 |
| JP | H7-260713 | A | 10/1995 |
| JP | H11-273597 | A | 10/1999 |
| JP | 2004-28845 | A | 1/2004 |
| JP | 2005-276760 | A | 10/2005 |
| JP | 2009-31167 | A | 2/2009 |
| JP | 2013-20788 | A | 1/2013 |
| JP | 2013-051152 | A | 3/2013 |
| JP | 2014-102926 | A | 6/2014 |
| JP | 2014-225403 | A | 12/2014 |
| JP | 2015-5337 | A | 1/2015 |
| JP | 2015-60731 | A | 3/2015 |
| WO | WO 2012/167822 | A1 | 12/2012 |
| WO | WO 2013/031535 | A2 | 3/2013 |

* cited by examiner

X-RAY TUBE AND X-RAY GENERATION DEVICE

TECHNICAL FIELD

One aspect of the present invention relates to an X-ray tube and an X-ray generation device.

BACKGROUND ART

A fixed anode X-ray tube described in Patent Literature 1 is known as a conventional X-ray tube. According to the fixed anode X-ray tube described in Patent Literature 1, heat electrons collide with a target provided on a target substrate inside a vacuum housing (anode base) to generate X-rays. The generated X-rays are transmitted through the target substrate, further transmitted through an X-ray emission window (window plate) attached to the vacuum housing, and applied to an object.

CITATION LIST

Patent Literature

Patent Literature 1: Japanese Unexamined Patent Publication No. H4-262348

SUMMARY OF INVENTION

Technical Problem

It has been demanded to develop an X-ray tube of the type described above, and capable of improving heat dissipation from the target and reducing thermal damage to the target.

Accordingly, an object of one aspect of the present invention is to provide an X-ray tube and an X-ray generation device capable of reducing thermal damage to a target.

Solution to Problem

According to one aspect of the present invention, an X-ray tube includes: a vacuum housing configured to include an internal space, the internal space being vacuum; a target unit disposed in the internal space, and configured to include a target configured to generate an X-ray by using an electron beam incident therein, and a target support unit configured to support the target, the X-ray generated by the target being transmitted through the target support unit; and an X-ray emission window provided so as to face the target support unit, and configured to seal an opening of the vacuum housing, the X-rays transmitted through the target support unit being transmitted through the X-ray emission window. At least a part of the X-ray emission window is in contact with the target support unit.

According to this X-ray tube, at least a part of the X-ray emission window is in contact with the target support unit. In this case, heat of the target can be conducted to the X-ray emission window via the target support unit by heat conduction. Accordingly, heat dissipation of the target can be promoted, wherefore thermal damage to the target can be reduced.

According to the X-ray tube of one aspect of the present invention, the target support unit may be included in the X-ray emission window as viewed in an X-ray emission direction of the X-ray emission window. This configuration can improve efficiency of heat dissipation of the target from the X-ray emission window via the target support unit (hereinafter also simply referred to as "heat dissipation efficiency").

According to the X-ray tube of one aspect of the present invention, a part of the X-ray emission window may be in contact with the target support unit, and the other part of the X-ray emission window may be separated from the target support unit. This configuration brings a part of the X-ray emission window into contact with the target support unit to increase heat dissipation of the target, and also separates the other part of the X-ray emission window from the target support unit to reduce an effect of stress caused by a vacuum state of the internal space and imposed on the target support unit.

According to the X-ray tube of one aspect of the present invention, a part of the X-ray emission window may be an area facing an electron incidence region of the target on the target support unit, and the other part of the X-ray emission window may be a peripheral portion of the X-ray emission window. This configuration can bring the X-ray emission window into contact with such a region which is particularly likely to have a high temperature, thereby increasing heat dissipation efficiency.

According to the X-ray tube of one aspect of the present invention, the X-ray emission window may have a protruding shape configured to protrude toward the target support unit and contact the target support unit. In this case, the number of parts required for the target support unit to come into contact with the X-ray emission window can decrease. The degree of freedom of the configuration of the target support unit can increase.

According to the X-ray tube of one aspect of the present invention, the target support unit may have a protruding shape configured to protrude toward the X-ray emission window and contact the X-ray emission window. In this case, the target support unit can support the X-ray emission window 30. Accordingly, the X-ray emission efficiency of the X-ray emission window can be raised by reducing the thickness of the X-ray emission window.

The X-ray tube of one aspect of the present invention may include a target shift unit configured to shift the target unit in a direction crossing an incidence direction of the electron beam. This configuration can shift the target unit using the target shift unit to change the incidence position of the electron beam into the target by the shift of the target. Life characteristics of the target therefore can improve.

The X-ray tube of one aspect of the present invention may further include an elastic member configured to press the target unit in such a direction as to approach the X-ray emission window. This configuration can bring the target close to the X-ray emission window, thereby decreasing a focus to object distance (FOD), which is a distance from an X-ray focal point to a test object.

An X-ray generation device according to one aspect of the present invention includes: the X-ray tube described above; a housing configured to house at least a part of the X-ray tube, insulating oil being sealed into the housing; and a power supply portion electrically connected to the X-ray tube via a power supply unit.

The X-ray generation device configured as above also offers the above-mentioned effect for reducing thermal damage to the target by using the X-ray tube described above.

Advantageous Effects of Invention

Provided according to one aspect of the present invention are an X-ray tube and an X-ray generation device capable of reducing thermal damage to a target.

Figure 3:
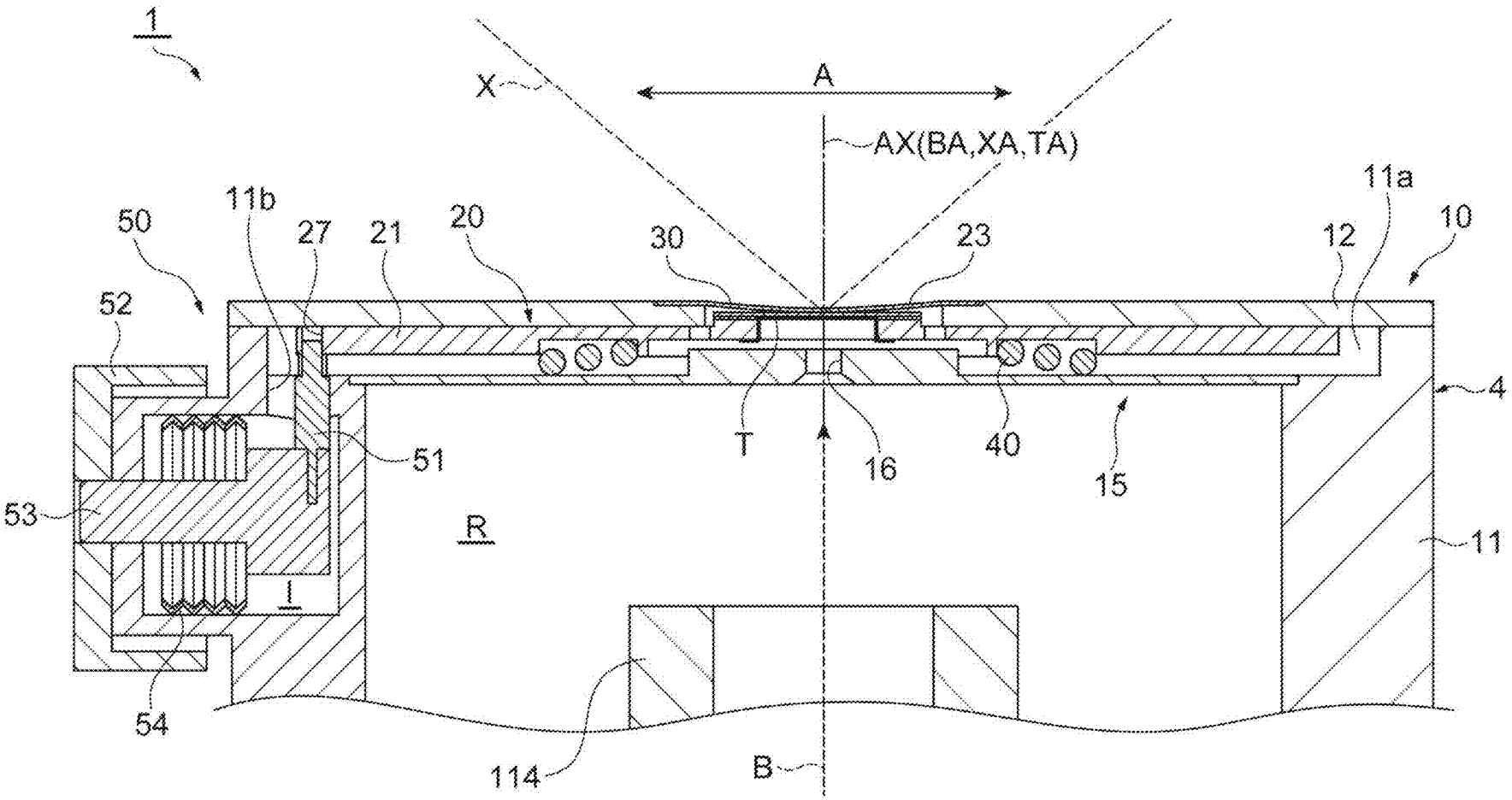
FIG. 3 is a longitudinal cross-sectional view showing an X-ray emission side of the X-ray tube according to the embodiment.
Figure 4:
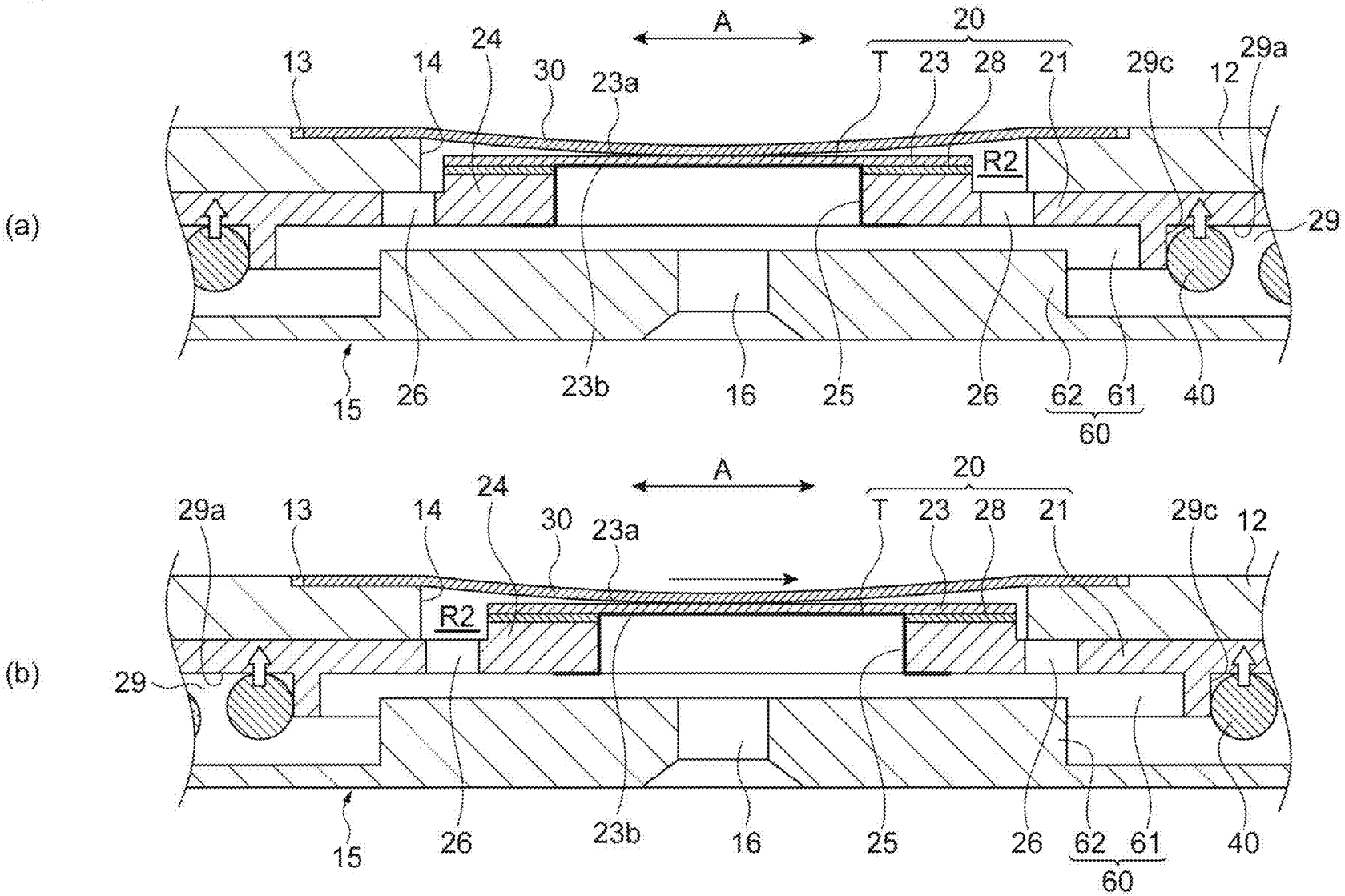

Part (a) of FIG. 4 is an enlarged longitudinal sectional view explaining a shift of a target unit in FIG. 3. Part (b) of FIG. 4 is another enlarged longitudinal cross-sectional view explaining the shift of the target unit in FIG. 3.

Figure 5:
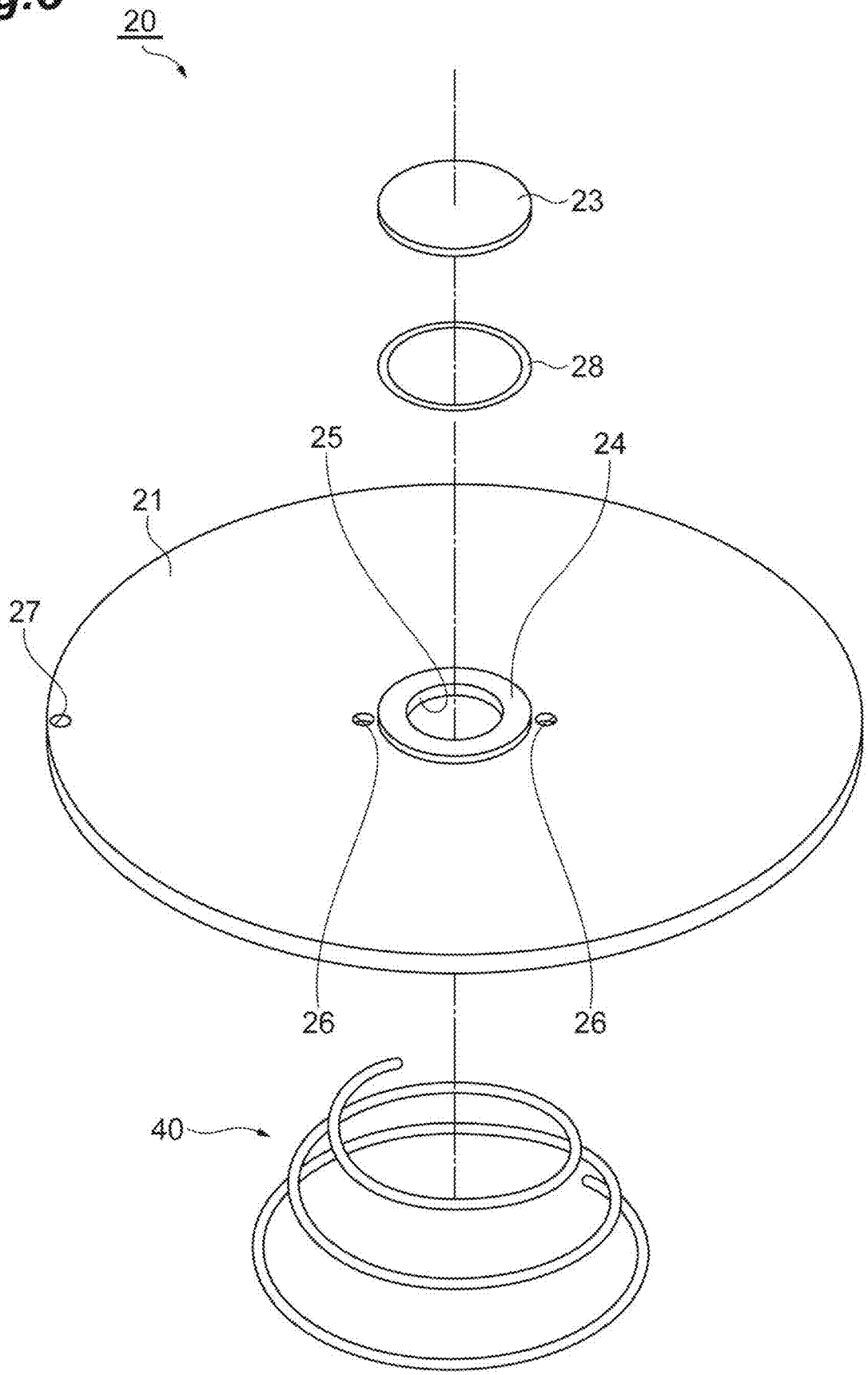

FIG. 5 is an exploded perspective view showing the target unit in FIG. 3.

Figure 6:
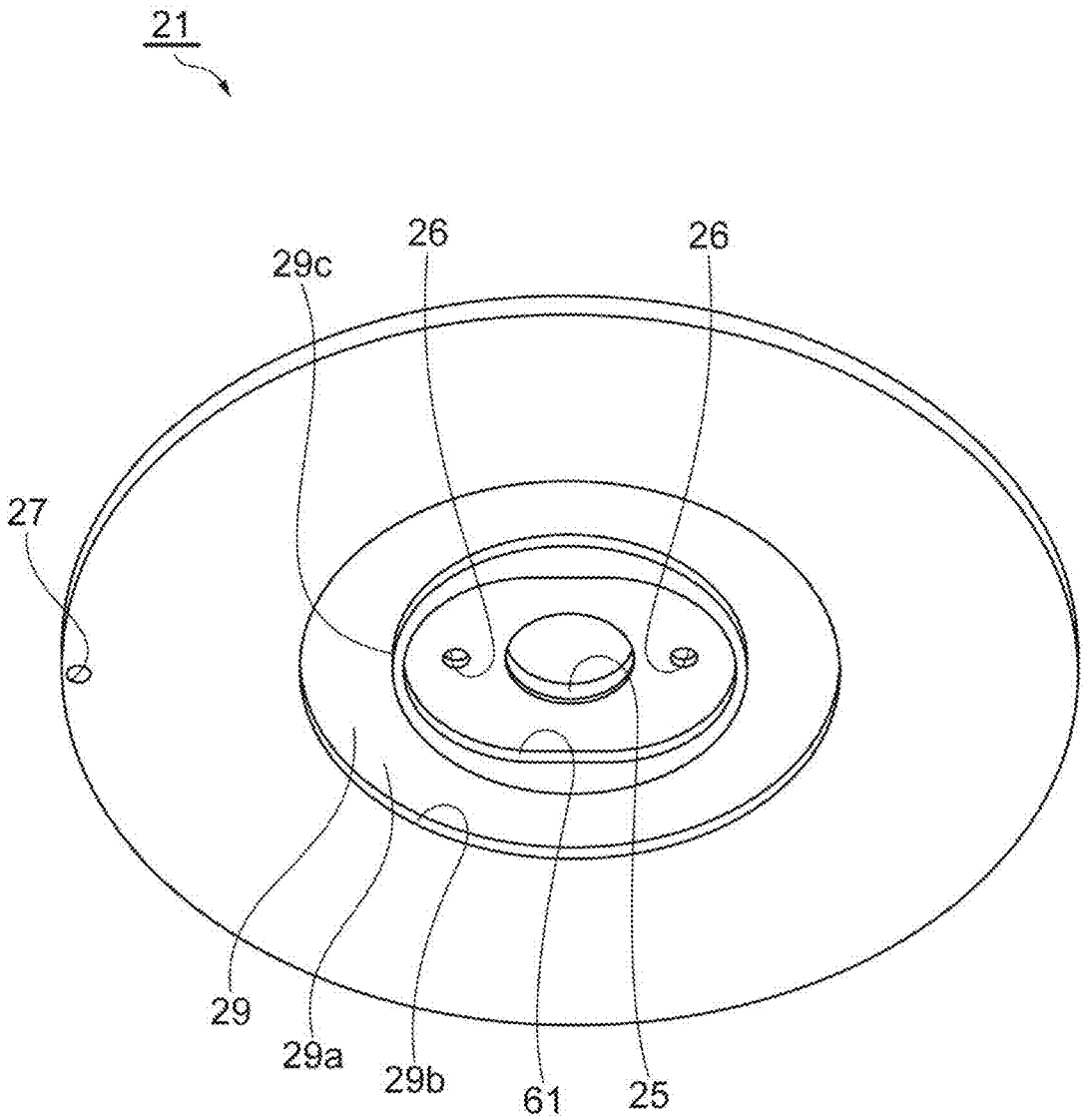

FIG. 6 is a perspective view showing a lower surface side of a target shift plate in FIG. 3.

Figure 7:
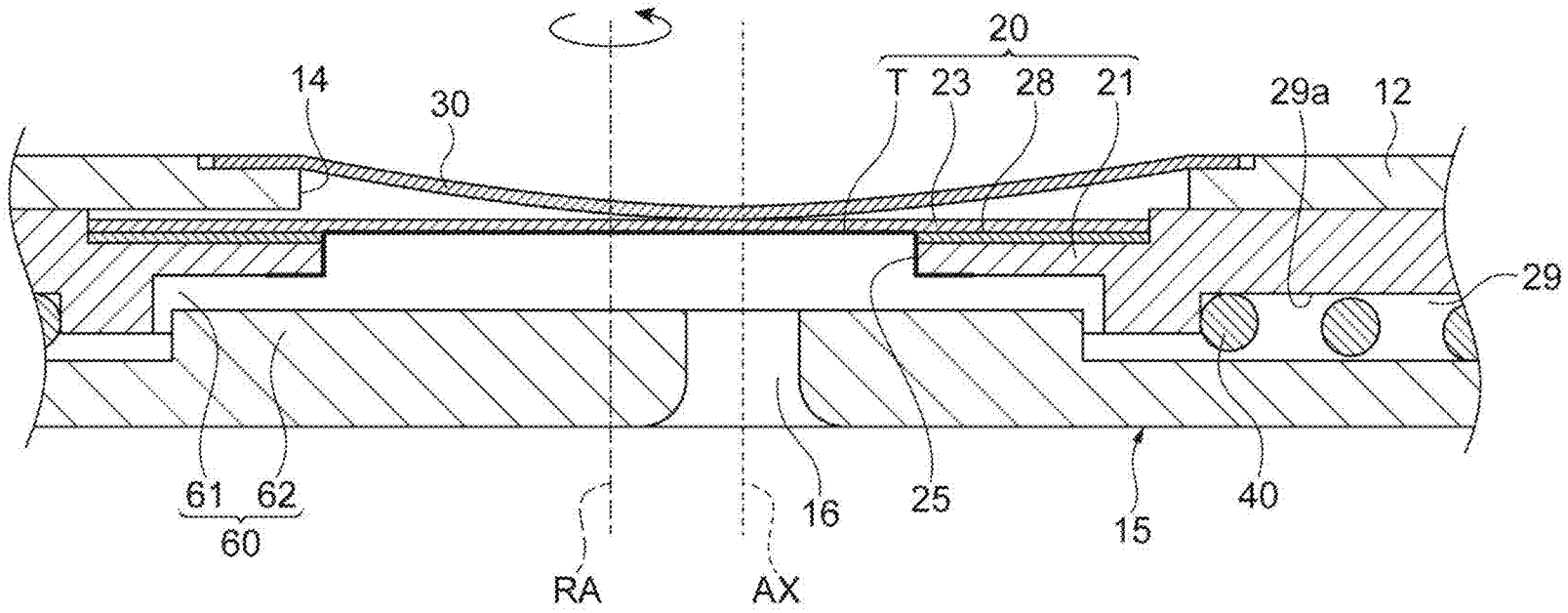

FIG. 7 is an enlarged longitudinal cross-sectional view explaining a shift of a target unit of an X-ray tube according to a modified example.

DESCRIPTION OF EMBODIMENT

An embodiment will be hereinafter described in detail with reference to the drawings. In the following description, identical or corresponding elements are given identical reference numerals, and the same description will be not be repeated.

Figure 1:
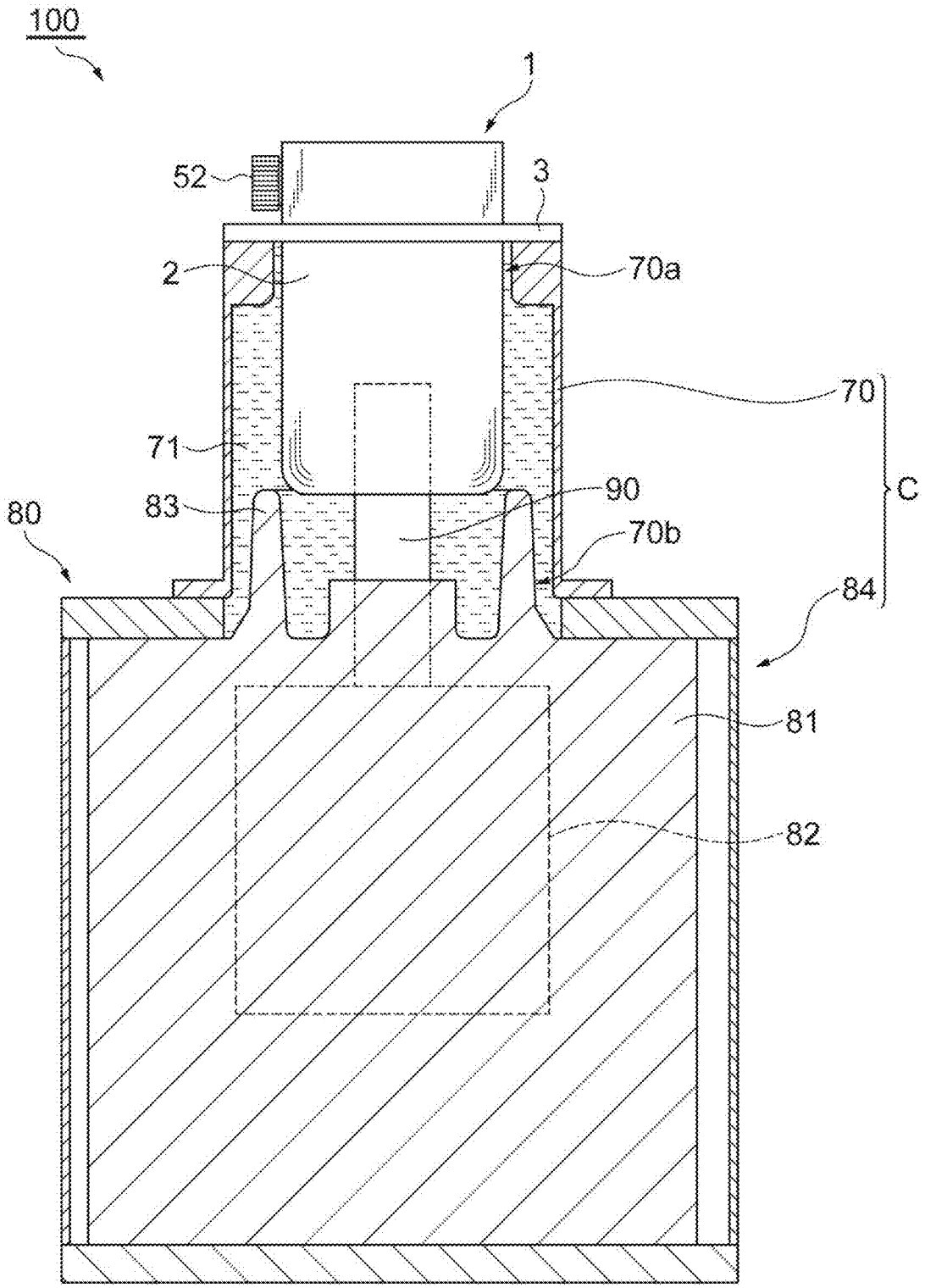
FIG. 1 is a longitudinal cross-sectional view showing an X-ray generation device according to an embodiment.
Figure 2:
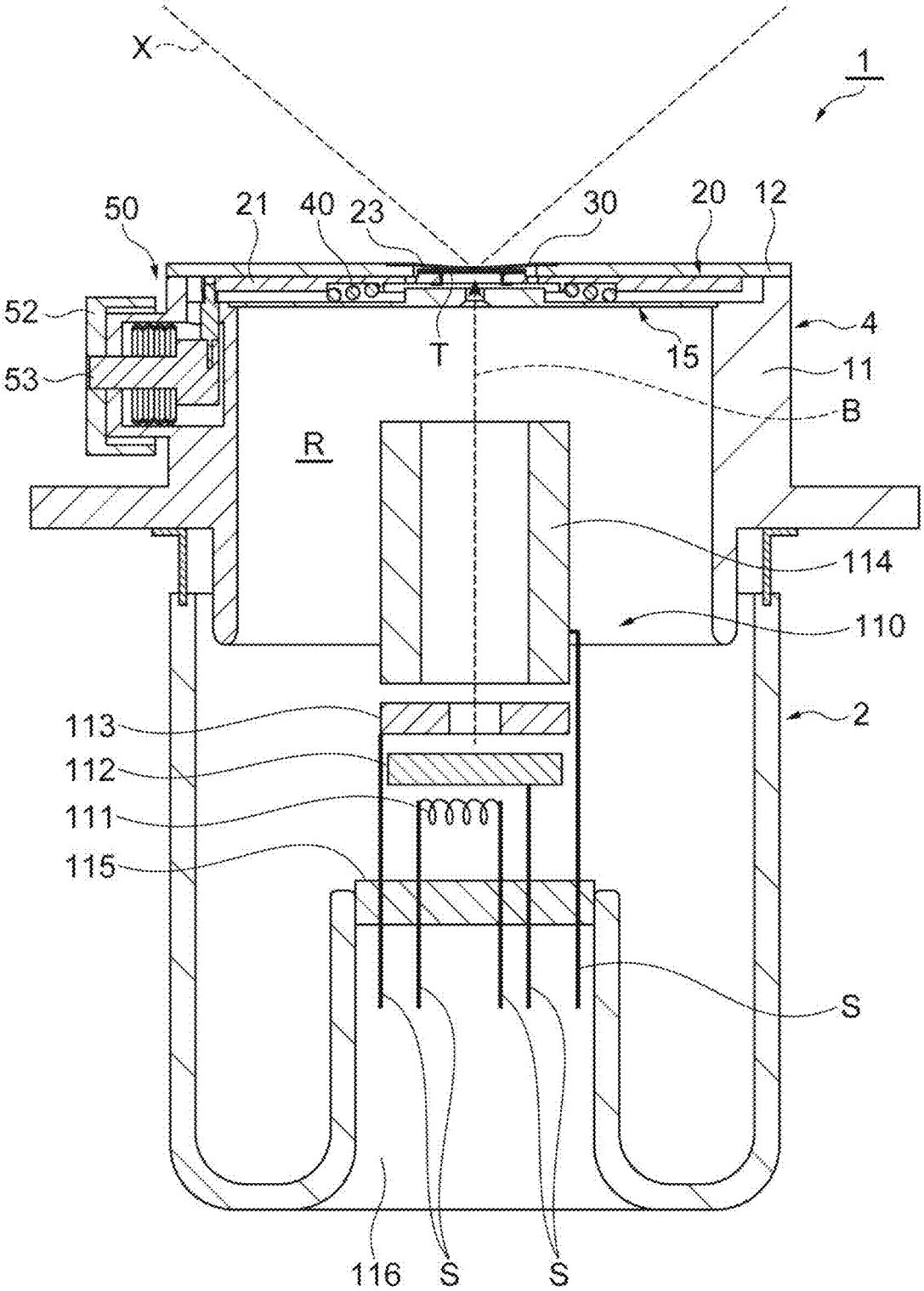
FIG. 2 is a longitudinal cross-sectional view showing an X-ray tube according to the embodiment.

FIG. 1 is a longitudinal cross-sectional view showing an X-ray generation device according to the embodiment. FIG. 2 is a longitudinal cross-sectional view showing an X-ray tube according to the embodiment. As shown in FIG. 1, an X-ray generation device 100 is a microfocus X-ray source used for X-ray nondestructive inspection for observing an internal structure of a test object, for example. The X-ray generation device 100 includes an X-ray tube 1, a housing C, and a power supply portion 80.

As shown in FIG. 2, the X-ray tube 1 is a transmission type X-ray tube which generates an X-ray X by using an electron beam B emitted from an electron gun 110 and entering a target T, and emits, from an X-ray emission window 30, the X-ray X transmitted through the target T. The X-ray tube 1 is a vacuum-sealed X-ray tube which includes a vacuum housing 10 having an internal space R as a vacuum space, and does not require component replacement and the like.

The vacuum housing 10 has a substantially cylindrical external shape. The vacuum housing 10 includes a head unit 4 made of a metal material (e.g., stainless steel), and an insulating valve 2 made of an insulating material (e.g., glass). The X-ray emission window 30 is fixed to the head unit 4. The head unit 4 has a main body 11 and an upper cover 12. The electron gun 110 is fixed to the insulating valve 2. The insulating valve 2 has a recess 116 folded and extended from an end facing the X-ray emission window 30 toward the X-ray emission window 30. The insulating valve 2 further includes a stem portion 115 so provided as to seal an end of the recess 116 on the X-ray emission window 30 side. The stein portion 115 holds the electron gun 110 at a predetermined position in the internal space R via a stem pin S used for power supply or other purposes. More specifically, the recess 116 increases a creepage distance between the head unit 4 and the electron gun 110 to improve withstand voltage characteristics, and positions the electron gun 110 close to the target T in the internal space R to easily produce a microfocus electron beam as the electron beam B.

The electron gun 110 includes a heater 111 constituted by a filament which generates heat when energized, a cathode 112 heated by the heater 111 to function as an electron emission source, and a first grid electrode 113 which controls an amount of electrons released from the cathode 112, and a second grid electrode 114 which has a cylindrical shape and focuses electrons having passed through the first grid electrode 113 toward the target T. The X-ray tube 1 is fixed to one end of a cylindrical member 70 described below. A not-shown exhaust pipe is attached to the X-ray tube 1. The X-ray tube 1 is vacuum-sealed by evacuating the inside through the exhaust pipe.

The housing C of the X-ray generation device 100 includes the cylindrical member 70, and a power supply portion case 84 which houses the power supply portion 80. The cylindrical member 70 is made of metal. The cylindrical member 70 has a cylindrical shape having openings at both ends. The insulating valve 2 of the X-ray tube 1 is inserted into an opening 70*a* on one end side of the cylindrical member 70. In this manner, the cylindrical member 70 houses at least a part of the X-ray tube 1. An attachment flange 3 of the X-ray tube 1 is brought into contact with one end surface of the cylindrical member 70, and fixed to the one end surface by a screw or the like. In this manner, the X-ray tube 1 seals the opening 70*a* while fixed at the opening 70*a* of the cylindrical member 70. Insulating oil 71, which is a liquid electrical insulating material, is sealed into the cylindrical member 70.

The power supply portion 80 has a function of supplying power to the X-ray tube 1. The power supply portion 80 includes an insulating block 81 made of epoxy resin, and an internal substrate 82 which includes a high-voltage generation circuit molded into the insulating block 81. The power supply portion 80 is housed in the power supply portion case 84 having a rectangular box shape. The other end side of the cylindrical member 70 (side opposite to the one end side corresponding to the X-ray tube 1 side) is fixed to the power supply portion 80. In this manner, an opening 70*b* on the other end side of the cylindrical member 70 is sealed, and the insulating oil 71 is airtightly sealed into the cylindrical member 70.

A high-voltage power supply unit 90, which includes a cylindrical socket electrically connected to the internal substrate 82, is disposed on the insulating block 81. The power supply portion 80 is electrically connected to the X-ray tube 1 via the high-voltage power supply unit 90. More specifically, one end of the high-voltage power supply unit 90 on the X-ray tube 1 side is electrically connected to a stem pin S inserted into the recess 116 of the insulating valve 2 of the X-ray tube 1 and projecting from the stem portion 115. In addition, the other end of the high-voltage power supply unit 90 on the power supply portion 80 side is fixed to the insulating block 81 while electrically connected to the internal substrate 82. The insulating block 81 includes a wall portion 83 which is annular and coaxial with the X-ray tube 1. The wall portion 83 projects in such a manner as to shield a connection portion between the cylindrical member 70 and the power supply portion 80 from the high-voltage power supply unit 90 in a state that the wall portion 83 is separated from the X-ray tube 1 and the cylindrical member 70. According to the present embodiment, the target T (anode) is set to a ground potential. A negative high voltage (e.g., from −10 kV to −500 kV) is supplied from the power supply portion 80 to the electron gun 110 via the high-voltage power supply unit 90.

FIG. 3 is a longitudinal cross-sectional view showing an X-ray emission side of the X-ray tube according to the embodiment. FIG. 4 is an enlarged longitudinal cross-sectional view explaining a shift of a target unit. FIG. 5 is an exploded perspective view showing the target unit. As shown in FIGS. 3 and 4, the X-ray tube 1 includes the vacuum housing 10, a target unit 20, the X-ray emission window 30, an elastic member 40, and a shift mechanism (target shift unit) 50.

In the description of the present embodiment, an emission direction side of an X-ray from the X-ray tube 1 is simply referred to as an "X-ray emission side" or an "upper side". According to the present embodiment, assuming that a tube axis of the X-ray tube 1 is an "axis TA", that an axis in a direction where the electron beam B enters the target T is an "axis BA", and that an axis in a direction where the X-ray X is emitted is an "axis XA", the electron beam B emitted from the electron gun 110 travels in the internal space R toward the target T in a direction coaxial with the axis TA, and enters the target T on the axis TA in a direction perpendicular to the target T to generate an X-ray. In this case, the axis TA, the axis BA, and the axis XA are all coaxial with each other, and therefore are also collectively referred to as an axis AX.

The head unit 4 is provided on the X-ray emission side of the vacuum housing 10 as a wall defining the internal space R. The head unit 4 includes the main body 11 and the upper cover 12 made of a metal material (e.g., stainless steel). The head unit 4 potentially corresponds to the anode of the X-ray tube 1. The main body 11 has a cylindrical shape. The main body 11 potentially corresponds to the anode of the X-ray tube 1. The main body 11 has a substantially cylindrical shape coaxial with the axis AX, and has openings at both ends. The upper cover 12 is fixed to an opening 11*a* at one end of the main body 11 on the X-ray emission side. The main body 11 communicates with the insulating valve 2 coaxial with the axis AX at an opening at the other end on the electron gun 110 side (see FIG. 2). A recess constituting a housing space I for housing the shift mechanism 50 is formed in a part of the wall surface of the main body 11. A radially inner and upper side of the housing space I communicates with the internal space R via a communication hole 11*b*. A pin 51 described below, which is a pin of the shift mechanism 50, is inserted into the communication hole 11*b*.

The upper cover 12 is provided in such a manner as to close the opening 11*a* at one end on the X-ray emission side of the main body 11 in a state that the upper cover 12 is electrically connected with the main body 11. The upper cover 12 has a disk shape coaxial with the axis AX. A recess 13 which has a circular cross section concentric with the upper cover 12 is formed in an upper surface of the upper cover 12. An opening 14 which has a circular cross section concentric with the upper cover 12 is formed in a bottom surface of the recess 13, and constitutes an X-ray passage hole coaxial with the axis AX.

The vacuum housing 10 further includes a support base (elastic member support unit) 15. The support base 15 has a disk shape disposed coaxially with the axis AX. The support base 15 is disposed in parallel to the upper cover 12 with a predetermined clearance left from the upper cover 12 in such a manner as to separate a space containing the target T (target unit 20) and a space containing the electron gun 110 in the internal space R. The support base 15 is installed on the lower side of the target unit 20 (electron gun 110 side opposite to X-ray emission window 30 side). The target unit 20 is placed on the support base 15 via the elastic member 40. The support base 15 supports the target unit 20 via the elastic member 40. The support base 15 includes an electron beam passage hole 16 which is a through hole having a circular cross section and coaxial with the axis AX, i.e., concentric with the support base 15. The electron beam passage hole 16 is a hole through which the electron beam B traveling toward the target T passes. The space containing the target T (target unit 20) and the space containing the electron gun 110 communicate with each other via at least the electron beam passage hole 16.

The target unit 20 is disposed in the internal space R. The target unit 20 includes the target T, a target shift plate (target holding unit) 21, and a target support substrate (target support unit) 23. The target T generates an X-ray by receiving the electron beam B. For example, the target T is constituted by tungsten. As described below, the target T is provided in a film shape at least on the lower surface of the target support substrate 23.

The target shift plate 21 holds the target T and the target support substrate 23. The target shift plate 21 shifts the target T in a shift direction A which is a predetermined direction crossing an incidence direction (application direction) of the electron beam B. The shift direction A herein is one direction crossing the incidence direction of the electron beam B into the target T, i.e., the axis BA (axis AX) at right angles, and also is a radial direction of the vacuum housing 10. The target shift plate 21 has a disk shape having a center axis extending in a direction along the axis BA (axis AX). The target shift plate 21 is shifted by the shift mechanism 50 such that the center axis moves in parallel to the shift direction A. The target shift plate 21 is made of a material having heat conductivity higher than a certain value, a coefficient of heat expansion close to that coefficient of the target support substrate 23, and less damaged or producing less foreign matters by friction than the target support substrate 23. For example, the target shift plate 21 is made of molybdenum. The target shift plate 21 is in contact with an inner wall surface of the upper cover 12, and is disposed in parallel to the upper cover 12.

A circular protrusion 24 coaxial with the target shift plate 21 is formed on an upper surface of the target shift plate 21. The circular protrusion 24 enters the opening 14 of the upper cover 12 in a state of contact between the target shift plate 21 and the upper cover 12. The circular protrusion 24 has an outer diameter smaller than an inner diameter of the opening 14. More specifically, the circular protrusion 24 has an eternal shape capable of shifting for a predetermined distance in the shift direction A within a space R2 described below and defined by the opening 14. The circular protrusion 24 includes a through hole 25 having a circular cross section and concentric with the target shift plate 21. The through hole 25 is an electron beam passage hole through which the electron beam B traveling toward the target T passes. The target shift plate 21 has a hole 27 into which the pin 51 of the shift mechanism 50 is inserted. The hole 27 is formed on one side in the shift direction A. The target shift plate 21 is connected to the shift mechanism 50 via the hole 27.

As shown in FIGS. 2 to 5, the target support substrate 23 supports the target T. The target support substrate 23 constitutes a first X-ray transmission window through which an X-ray generated by the target T is transmitted. The target support substrate 23 has a disk shape. For example, the target support substrate 23 is made of a material having high X-ray transparency, such as diamond and beryllium. The target support substrate 23 has a thickness in a range from 50 μm to 500 μm, and set to 250 μm in the present embodiment. An outer diameter of the target support substrate 23 may be equivalent to an outer diameter of the circular protrusion 24 of the target shift plate 21. The outer diameter of the target support substrate 23 may be slightly larger or smaller than the outer diameter of the circular protrusion 24. The target support substrate 23 is provided, via a seal member 28 having an annular shape, on the circular protrusion 24 in such a manner as to close the through hole 25. The seal member 28 joins the target shift plate 21 and the target support substrate 23. For example, the seal member 28 is made of aluminum. The target support substrate 23 and the seal member 28 are disposed coaxially with the target shift plate 21.

As shown in FIG. 4, the target T is formed in a film shape on a lower surface of the target support substrate 23. Specifically, the target T is formed in a film shape by vapor deposition in a region including the lower surface of the target support substrate 23, an inner surface of the through hole 25 of the target shift plate 21, and a lower surface of the target shift plate 21. A film thickness of the target T is in a range from 0.5 μm to 10 μm, and set to 2 μm in the present embodiment.

The X-ray emission window 30 is provided on the upper cover 12 of the vacuum housing 10 in such a position as to face the target support substrate 23. The X-ray emission window 30 is kept in such a size and a shape as to contain an X-ray emission portion of the target support substrate 23 as viewed coaxially with the axis AX (i.e., as viewed from above or as viewed in a direction facing the X-ray emission window 30 from outside). The X-ray emission window 30 constitutes a second X-ray transmission window through which an X-ray transmitted through the target support substrate 23 is transmitted. The X-ray emission window 30 has a disk shape. For example, the X-ray emission window 30 is made of a material having high X-ray transparency, such as beryllium and diamond. The X-ray emission window 30 is disposed coaxially with the axis AX on the bottom surface of the recess 13 of the upper cover 12. The X-ray emission window 30 seals the opening 14 of the vacuum housing 10. Specifically, the X-ray emission window 30 seals and holds, in a vacuum state, the opening 14 at an X-ray emission portion facing the target unit 20. A thickness of the X-ray emission window 30 is in a range from 50 μm to 1000 μm, and set to 300 μm in the present embodiment. The X-ray emission window 30 is larger than the target support substrate 23 as viewed in the X-ray emission direction of the X-ray emission window 30, and includes the target support substrate 23. In other words, the target support substrate 23 is included in the X-ray emission window 30 as viewed in the X-ray emission direction of the X-ray emission window 30.

A part of the X-ray emission window 30 is in contact with the target support substrate 23. Specifically, a central portion of the X-ray emission window 30 is in contact with an X-ray emission window side surface 23*a* which is an X-ray emission window 30 side surface of the target support substrate 23. More specifically, a region included in a surface of the X-ray emission window 30 on the internal space R side and facing an electron incidence region (X-ray generation region) TE of the target T provided on a target side surface 23*b*, which is a target T side surface of the target support substrate 23, comes into contact with the X-ray emission window side surface 23*a* of the target support substrate 23. The electron incidence region TE is an area where the electron beam B enters the target T, and therefore is an area where an X-ray X is generated. According to the example shown in the figure, the electron incidence region TE is an area facing the electron beam passage hole 16 of the support base 15 (region above the electron beam passage hole 16). The contact area is in a range from 1% to 100% of the area of the X-ray emission window side surface 23*a* of the target support substrate 23, and more specifically from 20% to 50% of that area. It is more effective to provide the electron incidence region TE of the target T on the target support substrate 23 as a region which has a contact area falling within the foregoing range in a substantially circular shape.

The other part of the X-ray emission window 30 is separated from the target support substrate 23. Specifically, a peripheral portion of the X-ray emission window 30 is separated from the target support substrate 23. The X-ray emission window 30 has a protruding shape which protrudes toward the target support substrate 23 and contacts the target support substrate 23. In other words, the X-ray emission window 30 is shaped such that a central portion of the X-ray emission window 30 is bent downward in a circular arc shape. Alternatively, the X-ray emission window 30 may have a cone shape or a frustum shape protruding downward as long as at least a top portion of the X-ray emission window 30 contacts the target support substrate 23.

The elastic member 40 presses the target unit 20 in such a direction as to approach the X-ray emission window 30. For example, the elastic member 40 is constituted by a substantially conical coil spring coaxial with the target shift plate 21. The elastic member 40 is made of metal. For example, the elastic member 40 is made of nickel chromium alloy. The elastic member 40 presses the target unit 20 in such a manner as to bring the target unit 20 into contact with the lower surface (inner wall surface of vacuum housing 10) of the upper cover 12.

The elastic member 40 is interposed between the target shift plate 21 and the support base 15. Specifically, the elastic member 40 is disposed between the target shift plate 21 and the support base 15 while compressing a substantially conical shape of the coil spring and deforming the conical shape into a substantially conical shape having a side surface less inclined. The elastic member 40 presses the lower surface of the target shift plate 21 toward the X-ray emission side with respect to the upper surface of the support base 15. For example, a spring constant of the elastic member 40, which is a conical coil spring, is in a range from 0.01 N/mm to 1 N/mm, and more specifically, 0.05 N/mm to 0.5 N/mm.

The shift mechanism 50 is a mechanism for shifting the target unit 20, which has been pressed by the elastic member 40, in the shift direction A. The shift mechanism 50 shifts the target unit 20 using a screw. The shift mechanism 50 has the pin 51, a crown 52, a screwing mechanism 53 and bellows 54.

The pin 51 is inserted from the housing space I of the main body 11 into the hole 27 of the target shift plate 21 through the communication hole 11*b* of the main body 11. The pin 51 advances and retreats (moves forward and backward) in the shift direction A. The communication hole 11*b* has a circular cross section having a diameter equal to or larger than a moving range of the pin 51. The crown 52 is a knob for operating the shift mechanism 50, and is disposed outside the housing space I. The screwing mechanism 53 is a mechanism which converts rotation of the crown 52 into linear movement of the pin 51. The bellows 54 are provided within the housing space I. The bellows 54 seal and hold the housing space I in a vacuum state, and expand and contract along with movement of the pin 51 while maintaining the vacuum state the housing space I. The bellows 54 are made of metal, and reduce gas release from the bellows 54.

According to the present embodiment, at least one of the upper surface of the target shift plate 21 (region contacting upper cover 12) and the lower surface of the upper cover 12 (region contacting target shift plate 21) is a rough surface portion having higher surface roughness than that of the surface of the target support substrate 23. In this case, at least one of the upper surface of the target shift plate 21 and the lower surface of the upper cover 12 is roughened. The surface roughness of at least one of the upper surface of the target shift plate 21 and the lower surface of the upper cover 12 is in a range from Rz 25 to Rz 0.025, for example, more specifically, in a range from Rz 6.3 to Rz 0.4.

FIG. 6 is a perspective view showing the lower surface side of the target shift plate. As shown in FIGS. 4 and 6, an annular groove (positioning portion) 29 concentric with the target shift plate 21 is formed in the lower surface of the target shift plate 21. The annular groove 29 has a rectangular cross section in an axial direction of the annular groove 29. The annular groove 29 accommodates at least a part of the elastic member 40 inside the annular groove 29. An inner surface of the annular groove 29 includes a bottom surface 29*a*, a side surface 29*b* present on an outer circumferential side, and a side surface 29*c* present on an inner circumferential side. The side surface 29*b* and the side surface 29*c* face each other with the bottom surface 29*a* interposed between the side surfaces 29*b* and 29*c* in the radial direction. The elastic member 40 is positioned in contact with at least the bottom surface 29*a*, and in contact with and fitted to at least one of the side surface 29*b* and the side surface 29*c*. In this manner, the annular groove 29 positions the elastic member 40 with respect to the target shift plate 21. According to the present embodiment, the elastic member 40 is positioned in contact with all of the bottom surface 29*a*, the side surface 29*b*, and the side surface 29*c*, and in a state fitted into the annular groove 29. An upper surface of the support base 15 is a flat surface on which the elastic member 40 can slide in the shift direction A. In this configuration, the elastic member 40 is slidably held on the upper surface of the support base 15 between the target unit 20 and the support base 15 so as to be accommodated in the annular groove 29. During a shift of the target unit 20, the elastic member 40 is accommodated in the annular groove 29, and slides on the upper surface of the support base 15 while positioned within the annular groove 29 by contact with a surface constituting the annular groove 29 to shift in accordance with the target unit 20.

The target shift plate 21 has a pair of through holes 26 formed around the circular protrusion 24 with the circular protrusion 24 interposed between the through holes 26. The pair of through holes 26, which are disposed on one side and the other side of the circular protrusion 24 in the shift direction A, penetrate the target shift plate 21 in a thickness direction. The through holes 26 communicate with the inside of the space R2, which space is defined between the target support substrate 23 and the X-ray emission window 30 in the internal space R, and with the outside of the space R2. The through holes 26 allow air in the space R2 to flow out from the space R2 during vacuum drawing of the inside of the vacuum housing 10.

The X-ray tube 1 also includes a guide unit 60 which guides a shift of the target unit 20 shifted by the shift mechanism 50. The guide unit 60 includes a recess 61 formed in the lower surface of the target shift plate 21 and elongated in the shift direction A, and a protrusion 62 provided on the upper surface of the support base 15 and having a circular shape which surrounds the electron beam passage hole 16 in such a shape as to be concentric with the support base 15. The target unit 20 and the support base 15 are separated by an elastic force of the elastic member 40 so as to be spatially separated from each other without contact between a lower side surface of the recess 61 and an upper side surface of the protrusion 62. The recess 61 has a predetermined length in the shift direction A. The recess 61 is disposed concentrically with the target shift plate 21 and radially inside the annular groove 29 of the target shift plate 21, and surrounds the through hole 25 and the pair of through holes 26. A short axis length (length in the direction perpendicular to the shift direction A) of the recess 61 is substantially equal to a diameter of the protrusion 62, while a long axis length of the recess 61 (predetermined length in the shift direction A) is larger than the diameter of the protrusion 62. More specifically, the recess 61 has a shape substantially equal to a shape obtained by projecting a locus produced when the protrusion 62 moves for a predetermined distance in the shift direction A (region through which the protrusion 62 passes). The protrusion 62 has a circular shape concentric with the support base 15, and protrudes upward. A distal end side of the protrusion 62 enters the recess 61.

Accordingly, movement of the recess 61, and consequent movement of the target shift plate 21 (target unit 20) are permitted in the shift direction A within a range of a predetermined length in directions crossing the X-ray emission direction at right angles (protrusion 62 and recess 61 do not interfere with each other). On the other hand, movement of the recess 61, and consequent movement of the target shift plate 21 (target unit 20) are regulated in a direction other than the shift direction A in directions crossing the X-ray emission direction at right angles (protrusion 62 and recess 61 interfere with each other).

According to the X-ray tube 1 configured as described above, the electron beam B is emitted from the electron gun 110 disposed in the internal space R, and enters the target T to generate the X-ray X. The generated X-ray X passes through the target support substrate 23, and then passes through the X-ray emission window 30. Thereafter, the X-ray-X is emitted to the outside of the X-ray tube 1, and applied to a test object.

Heat generated as a result of incidence of the electron beam B into the target T is conducted to the X-ray emission window 30 via the target support substrate 23, transferred toward a peripheral portion of the upper cover 12 or the like at the X-ray emission window 30, and efficiently dissipated.

According to the X-ray tube 1, the crown 52 of the shift mechanism 50 is rotated to move the pin 51 in the shift direction A by a screwing action of the screwing mechanism 53. In this case, as shown in (a) and (b) of FIG. 4, the target shift plate 21 of the target unit 20 pressed upward by the elastic member 40 is shifted in the shift direction A while sliding on the inner wall surface of the upper cover 12. As a result, the target T is shifted in the shift direction A. Accordingly, an incidence point of the electron beam B into the target T shifts (changes) in the shift direction A. In other words, an intersection of the target T and the axis BA (axis AX) shifts (changes) in the shift direction A of the target T. When the target T shifts to one side in the shift direction A, the incidence point of the electron beam B into the target T (intersection of the incidence point and the axis BA (axis AX) on the target T) shifts to the other side in the shift direction A.

According to the X-ray tube 1 and the X-ray generation device 100 of the present embodiment described above, at least a part of the X-ray emission window 30 is in contact with the target support substrate 23. In this case, heat of the target T of the target unit 20 housed in a vacuum having low heat conductivity can be conducted to the X-ray emission window 30 via the target support substrate 23 by heat conduction. Accordingly, heat dissipation of the target T can be promoted, wherefore thermal damage to the target T can be reduced. Life characteristics of the target T therefore can improve.

According to the present embodiment, the target support substrate 23 is included in the X-ray emission window 30 as viewed in the X-ray emission direction of the X-ray emission window 30, in other words, as viewed coaxially with the axis AX (i.e., as viewed from above or as viewed in a direction facing the X-ray emission window 30 from outside). This configuration produces a large heat capacity of the X-ray emission window 30, thereby effectively conducting heat from the target support substrate 23 to the X-ray emission window 30. For example, heat dissipation efficiency can improve more than such a configuration that the X-ray emission window 30 is included in the target support substrate 23.

According to the present embodiment, a part of the X-ray emission window 30 is in contact with the target support substrate 23, and the other part of the X-ray emission window 30 is separated from the target support substrate 23. This configuration brings a part of the X-ray emission window 30 into contact with the target support substrate 23 to increase heat dissipation of the target T, and also separates the other part of the X-ray emission window 30 from the target support substrate 23 to reduce an effect of stress caused by a vacuum state of the internal space R and imposed on the target support substrate 23. In addition, when the X-ray emission window 30 and the target support substrate 23 are in full contact with each other, a possibility of damage caused by friction of the X-ray emission window 30 and the target support substrate 23 increases during a shift of the target unit 20 in the shift direction A. However, both heat dissipation and mobility are achievable in the state of contact between a part of the X-ray emission window 30 and the target support substrate 23 and separation between the other part of the X-ray emission window 30 and the target support substrate 23.

According to the present embodiment, a part of the X-ray emission window 30 in contact with the target support substrate 23 corresponds to a region facing the electron incidence region TE of the target T on the target support substrate 23. The other part of the X-ray emission window 30 separated from the target support substrate 23 corresponds to a peripheral portion of the X-ray emission window 30. This configuration can bring the X-ray emission window 30 into contact with such a region which is particularly likely to have a high temperature, thereby increasing heat dissipation efficiency. This configuration can easily conduct heat from the electron incidence region TE, which particularly generates heat in the target T, to the X-ray emission window 30. Moreover, during the shift the target unit 20 in the shift direction A, the central portion of the X-ray emission window 30 similarly comes into contact, while the peripheral portion separates. Accordingly, the target unit 20 can be shifted in any shift direction with a uniform force while reducing biased stress applied to the X-ray emission window 30.

According to the present embodiment, the X-ray emission window 30 has a protruding shape which protrudes toward the target support substrate 23 and contacts the target support substrate 23. In this case, the number of parts required for the target support substrate 23 to come into contact with the X-ray emission window 30 decreases, wherefore the degree of freedom of the configuration of the target support substrate 23 increases. Accordingly, contact between the target support substrate 23 and the X-ray emission window 30 is easily achievable with priority given to effectiveness in generating X-rays.

According to the present embodiment, the shift mechanism 50 for shifting the target unit 20 in the shift direction A is provided. This configuration can shift the target unit 20 using the shift mechanism 50 to change the incidence position of the electron beam B into the target T by the shift of the target T. Life characteristics of the target T therefore can improve.

According to the present embodiment, there is provided the elastic member 40 which presses the target unit 20 in such a direction as to approach the X-ray emission window 30. This configuration can bring the target T close to the X-ray emission window 30, thereby decreasing a focus to object distance (FOD), which is a distance from an X-ray focal point to a test object.

According to the present embodiment, following effects are also offered.

The target unit 20 includes the target shift plate 21, and the elastic member 40 presses the target shift plate 21. This configuration reduces physical stress caused by the shift of the target unit 20 and the press by the elastic member 40, and directly applied to the target T and the target support substrate 23. This configuration therefore can reduce an adverse effect of physical stress on the target T and the target support substrate 23 which considerably affect generation of X-rays, and therefore achieve generation of stable X-rays. Moreover, strength sufficient for physical stress need not be considered in selecting materials of the target T and the target support substrate 23. Accordingly, these materials can be selected with emphasis on the characteristics or heat dissipation of the X-ray generation.

The elastic member 40 is made of metal. This configuration can reduce gas release from the elastic member 40, and therefore achieve stable generation of X-rays. At the time of evacuation of the X-ray tube 1, the X-ray tube 1 may be heated and evacuated to increase the degree of vacuum. When the elastic member 40 is made of metal, a quality change of the material, a change of elasticity or the like of the elastic member 40 as a result of heating can be reduced. The annular groove 29 is provided in the lower surface of the target shift plate 21 of the target unit 20 as a positioning portion for positioning the elastic member 40. This configuration can position the elastic member 40, maintain the position of the elastic member 40 at a fixed position (hold for stabilization), and reduce a change of the FOD.

The elastic member 40 is slidably held on the upper surface of the support base 15 between the target unit 20 and the support base 15 so as to be accommodated in the annular groove 29. In this case, the elastic member 40 slides on the support base 15 while securely positioned in the annular groove 29 during the shift of the target unit 20. Accordingly, a change of the pressing direction of the elastic member 40 caused by the effect of the shift of the target unit 20 can be reduced. This configuration therefore can maintain a fixed positional relationship between the target unit 20 and the X-ray emission window 30. This configuration can shift the elastic member 40 along with the target unit 20 during the shift of the target unit 20, and therefore can maintain the fixed positional relationship between the elastic member 40 and the target unit 20. Accordingly, this configuration can reduce a biased pressing force applied to the target unit 20, or a change of distribution of the pressing force caused by the effect of the shift.

There is provided the guide unit 60 which guides a shift of the target unit 20 shifted by the shift mechanism 50. Accordingly, a shift of the target unit 20 in an unintended direction is avoidable. In this case, a shift of the target unit 20 in a random direction decreases, wherefore the electron incidence position into the target T is securely recognizable. Accordingly, use of a portion previously used for X-ray generation again is avoidable. The guide unit 60 includes the recess 61 provided in the target shift plate 21, and the protrusion 62 formed on the support base 15 and entering the recess 61. In this case, the guide unit 60 can guide the shift of the target unit 20 by using the recess 61 and the protrusion 62. Accordingly, the configuration of the guide unit 60 can be simplified.

The elastic member 40 presses the target unit 20 in such a manner as to bring the target unit 20 into contact with the lower surface of the upper cover 12. This configuration can position the target unit 20 on the lower surface of the upper cover 12, maintain the position of the target unit 20 at a fixed position (hold for stabilization), and reduce a change of the FOD. Moreover, this configuration can easily conduct heat from the target unit 20 to the upper cover 12, wherefore heat dissipation of the target T improves.

At least one of the upper surface of the target shift plate 21 and the lower surface of the upper cover 12 is a rough surface portion having higher surface roughness than surface roughness of the surface of the target support substrate 23. This configuration can reduce a contact area between the target unit 20 and the vacuum housing 10 in contact with each other, and reduce resistance produced during the shift of the target unit 20. For reducing the resistance during the shift of the target unit 20, it is also preferable that the contact portion between the target shift plate 21 and the upper cover 12, i.e., the upper surface of the target shift plate 21 and the lower surface of the upper cover 12 are made of materials different from each other. Concerning this respect, the target shift plate 21 is made of molybdenum, while the upper cover 12 is made of stainless steel according to the present embodiment. When surface smooth members are in surface contact with each other under vacuum, a large force may be required to change a positional relationship of the respective surface smooth members. This force may damage the shift mechanism 50 or the target shift plate 21. However, the rough surface portion thus provided can facilitate the shift of the target unit 20, and reduce damage of the shift mechanism 50 or the target shift plate 21.

The target unit 20 includes the through holes 26 communicating with the inside and the outside of the space R2. Accordingly, evacuation using the through holes 26 is efficiently achievable. When gas such as air remains in the space R2 which is a space near the target T heated to have a high temperature by incidence of the electron beam B, members in the vicinity of the space R2 (e.g., target support substrate 23 or X-ray emission window 30) react with the gas and deteriorate easily. However, by efficiently evacuating the space R2, remaining gas decreases, and deterioration of the members is avoidable.

The X-ray tube 1 is constituted by a vacuum-sealed X-ray tube. Accordingly, complicated maintenance is not required. The elastic member 40 and the bellows 54 are made of metal. This configuration can reduce lowering of the degree of vacuum in the X-ray tube 1 as a result of gas discharge in comparison with the elastic member 40 and the bellows 54 made of resin, and also increase temperature tolerance to cope with a tube baking process.

One aspect of the present invention is not limited to the embodiment described herein.

According to the above embodiment, the target support substrate 23 may have a protruding shape (e.g., pyramid shape or truncated pyramid shape) protruding toward the X-ray emission window 30 and contacting the X-ray emission window 30. In this case, the target support substrate 23 can support the X-ray emission window 30. Accordingly, the X-ray emission efficiency of the X-ray emission window 30 can be raised by reducing the thickness of the X-ray emission window 30.

According to the above embodiment, the portion of the X-ray emission window 30 in contact with the target support substrate 23 is not particularly limited to a specific portion, but may be any portion other than the central portion of the X-ray emission window 30. Contact between a certain position of the X-ray emission window 30 and the target support substrate 23 is only required. Contact between at least a part of the X-ray emission window 30 and the target support substrate 23 is only required.

According to the above embodiment, the electron incidence region TE is also considered as an area corresponding to the through hole 25 of the target shift plate 21. Any configuration may be adopted as long as the part of the X-ray emission window 30 in contact with the target support substrate 23 includes at least a part of the region of the target support substrate 23 facing the electron incidence region TE.

According to the above embodiment, the elastic member 40 is constituted by the coil spring made of metal and having a substantially conical shape. However, the number, material, structure, type and the like of the elastic member 40 are not specifically limited. Various types of member may be employed as long as the target unit 20 can be pressed in such a direction as to approach the X-ray emission window 30. For example, the elastic member 40 may be constituted by a plurality of coil springs, or a leaf spring. Moreover, the elastic member 40 may be fixed to the main body 11 or the upper cover 12, unlike the configuration of the above embodiment in which the support base 15 as an elastic member support unit is provided.

According to the above embodiment, the target unit 20 shifts in the shift direction A. However, the shift direction of the target unit 20 is not specifically limited. The shift direction may be any direction crossing the incidence direction of the electron beam B (up-down direction in FIG. 2). The shift of the target unit 20 is not limited to a linear shift, but may be a rotational shift as shown in FIG. 7, for example. According to the example shown in FIG. 7, the protrusion 62 having a circular shape is provided eccentrically with the axis AX on the support base 15 disposed coaxially with the axis AX. The electron beam passage hole 16 of the support base 15 is provided coaxially with the axis AX. On the other hand, the target unit 20 itself is provided eccentrically to the axis AX. The recess 61 of the target shift plate 21 of the target unit 20 is concentric with the target unit 20, and has a circular shape having an inner diameter slightly larger than the outer diameter of the protrusion 62. In the state that the protrusion 62 enters the recess 61, the target unit 20 provided eccentrically to the axis AX is rotationally movable around an axis RA which is a center axis of the protrusion 62 and also is a rotational axis eccentric to the axis AX. The target unit 20 is rotated by a not-shown shift mechanism (e.g., mechanism which rotates the target unit 20 using magnetic force or using a gear) to shift in a direction crossing the incidence direction of the electron beam B (rotation direction around axis RA). Moreover, the shift of the target unit 20 is not limited to a linear shift or a rotational shift, but may be a combination of linear and rotational shifts.

According to the above embodiment, all the axis TA, the axis XA and the axis BA are coaxial with each other. However, the respective axes TA, XA, and BA may be different axes. According to the above embodiment, the shift mechanism 50 uses a screw to shift the target unit 20. However, the shift mechanism 50 is not specifically limited. Various types of mechanism may be used as long as the target unit 20 pressed by the elastic member 40 can be shifted in the shift direction A. The shift mechanism 50 may be a mechanism for manually shifting the target unit 20, or may be a mechanism for electrically and automatically shifting the target unit 20.

According to the above embodiment, the guide unit 60 is constituted by the recess 61 and the protrusion 62. However, the guide unit 60 is not specifically limited, but may be any unit as long as the shift of the target unit 20 by the shift mechanism 50 can be guided. According to the above embodiment, the annular groove 29 as the positioning portion of the elastic member 40 is provided in the target shift plate 21. However, a positioning portion may be provided in the support base 15 instead of or in addition to the annular groove 29. In this case, the elastic member 40 may be brought into a state slidably held on the target shift plate 21, instead of or in addition to the state slidably held on the upper surface of the support base 15.

According to the above embodiment, the positioning portion of the elastic member 40 may limit (regulate) the shift of the elastic member 40 within a predetermined range, rather than fixing the elastic member 40. In this case, the elastic member 40 may slide within the predetermined range of the positioning portion during the shift of the target unit 20.

According to the above embodiment, at least one of the upper surface of the target shift plate 21 and the lower surface of the upper cover 12 is a rough surface portion. However, other configurations may be adopted. Only a part of the upper surface of the target shift plate 21 may be a rough surface, or only a part of the lower surface of the upper cover 12 may be a rough surface. Alternatively, at least a combination these parts may be adopted.

According to the above embodiment, the upper surface of the target shift plate 21 and the lower surface of the upper cover 12 are not particularly surface-treated. However, at least one of the upper surface of the target shift plate 21 and the lower surface of the upper cover 12 may be subjected to surface treatment for preventing easy junction to the other side (e.g., oxidation treatment or nitridation treatment). According to the above embodiment, coating is not particularly formed on each of the upper surface of the target shift plate 21 and the lower surface of the upper cover 12. However, coating for reducing frictional force (e.g., metal coating softer than the upper surface of the target shift plate 21 or the lower surface of the upper cover 12) may be formed on at least one of the upper surface of the target shift plate 21 and the lower surface of the upper cover 12. According to the above embodiment, the upper surface of the target shift plate 21 and the lower surface of the upper cover 12 are in contact with each other. However, resistance during the shift of the target unit 20 may be reduced by interposing a bearing or a spherical member between the upper surface of the target shift plate 21 and the lower surface of the upper cover 12.

According to the above embodiment, a space is formed between the support base 15 and the X-ray emission window 30. However, the space between the support base 15 and the X-ray emission window 30 may be filled with a material having high heat conductivity. In this case, heat of the target unit 20 can be easily conducted to the X-ray emission window 30, wherefore heat dissipation of the target unit 20 improves. In this case, the route of the electron beam B or the X-ray X is not filled with the material to eliminate effect on incidence of the electron beam B or emission of the X-ray X.

In the above description, the "contact" includes direct contact (i.e., direct contact without interposition of another member). The "contact" includes thermal contact (contact allowing heat conduction). The "contact" may include indirect conduct (i.e., contact with interposition of another member).

REFERENCE SIGNS LIST

1 X-ray tube
10 Vacuum housing
14 Opening
20 Target unit
23 Target support substrate (target support unit)
30 X-ray emission window
40 Elastic member
50 Shift mechanism (target shift unit)
70 Cylindrical member
71 Insulating oil
80 Power supply portion
B Electron beam
R Internal space
T Target
TE Electron incidence region

The invention claimed is:

1. An X-ray tube comprising:

a vacuum housing configured to include an internal space, the internal space being vacuum;

a target unit disposed in the internal space, and configured to include a target configured to generate an X-ray by using an electron beam incident therein, and a target support unit configured to support the target, the target support unit constituting a first X-ray transmission window configured to transmit the X-ray generated in the target, a region of the target support unit facing the electron-incident region of the target being formed of an X-ray transmitting material; and an X-ray emission window provided so as to face the target support unit, and configured to seal an opening of the vacuum housing, the X-ray emission window constituting a second X-ray transmission window configured to transmit the X-ray transmitted through the target support unit, wherein at least a part of the X-ray emission window is in contact with the target support unit in a region where the X-ray emission window faces the electron-incident region of the target.

2. The X-ray tube according to claim 1, wherein the target support unit is included in the X-ray emission window as viewed in an X-ray emission direction of the X-ray emission window.

3. The X-ray tube according to claim 1, wherein another part of the X-ray emission window is separated from the target support unit.

4. The X-ray tube according to claim 3, wherein the another part of the X-ray emission window is a peripheral portion of the X-ray emission window.

5. The X-ray tube according to claim 3, wherein the X-ray emission window has a protruding shape configured to protrude toward the target support unit and contact the target support unit.

6. The X-ray tube according to claim 3, wherein the target support unit has a protruding shape configured to protrude toward the X-ray emission window and contact the X-ray emission window.

7. The X-ray tube according to claim 1, further comprising a target shift unit configured to shift the target unit in a direction crossing an incidence direction of the electron beam.

8. The X-ray tube according to claim 1, further comprising an elastic member configured to press the target unit in such a direction as to approach the X-ray emission window.

9. An X-ray generation device comprising:

the X-ray tube according to claim 1;

a housing configured to house at least a part of the X-ray tube, insulating oil being sealed into the housing; and a power supply portion electrically connected to the X-ray tube via a power supply unit.

* * * * *